US006145326A

United States Patent [19]

O'Brien

[11] Patent Number: 6,145,326

[45] Date of Patent: Nov. 14, 2000

[54] FORCED OIL COOLING FOR REFRIGERATION COMPRESSOR

[75] Inventor: Daniel James O'Brien, Andover, Minn.

[73] Assignee: Systematic Refrigeration, Inc., Dayton, Minn.

[21] Appl. No.: 09/302,242

[22] Filed: Apr. 29, 1999

[51] Int. Cl.[7] ..... F25B 43/02

[52] U.S. Cl. ..... 62/84; 62/193; 62/470

[58] Field of Search ..... 62/84, 468, 470, 62/192, 193

[56] References Cited

U.S. PATENT DOCUMENTS

| | | | |
|---|---|---|---|
| 3,021,689 | 2/1962 | Miller | 62/192 |
| 5,134,856 | 8/1992 | Pillis et al. | 62/193 |
| 5,522,233 | 6/1996 | Nares et al. | 62/193 |
| 5,606,872 | 3/1997 | Terasaki | 62/471 |
| 5,894,740 | 4/1999 | Rentz | 62/468 |

OTHER PUBLICATIONS

Two schematic diagrams of a prior art refrigeration system sold by Delta Heat Transfer, Inc. of Flowery Branch, Georgia, Figures 1 and 2, 2 pages (Date Unknown).

*Primary Examiner*—William Doerrler
*Assistant Examiner*—Melvin Jones
*Attorney, Agent, or Firm*—Merchant & Gould P.C.

[57] ABSTRACT

The invention is a method and apparatus for cooling compressor oil in a refrigeration system by passing the oil through a heat exchanger cooled by evaporating refrigerant. The refrigerant is pumped into the heat exchanger by a liquid refrigerant pump. The use of the pump avoids the requirement of a mixing pipe with an internal venturi nozzle, while also providing oil-cooling that is relatively free of noise and disturbance to those in the vicinity of the refrigeration unit.

14 Claims, 3 Drawing Sheets

FORCED OIL COOLING FOR REFRIGERATION COMPRESSOR

BACKGROUND

The invention is directed to refrigeration systems, and more particularly to the cooling of oil for compressors used in refrigeration systems.

Some compressors used in refrigeration systems, such as screw-type compressors, release oil into the refrigerant as it passes through the compressor. The oil is heated as a result of the compression of the refrigerant, and is subsequently separated from the refrigerant, typically in a separation tank. The oil has to be cooled before being returned to the compressor. Therefore, there is a need to provide a method of cooling the oil that is efficient, inexpensive, and compatible with the environment of the refrigeration system.

SUMMARY OF THE INVENTION

Generally, the present invention relates to a method and apparatus for cooling compressor oil in a refrigeration system by passing the oil through a heat exchanger cooled by evaporating refrigerant. The refrigerant is pumped into the heat exchanger by a liquid refrigerant pump.

In one embodiment, the invention includes an apparatus for cooling oil in a refrigeration system compressor. The apparatus includes one or more compressors coupled to receive gaseous refrigerant from cooling units and an oil separator coupled to the one or more compressors to receive compressed refrigerant gas therefrom and to separate oil from the compressed refrigerant gas. The apparatus further includes a condenser unit coupled to receive compressed refrigerant gas from the oil separator and a liquid pump coupled to receive liquid refrigerant from the condenser unit. An oil heat exchanger is coupled to receive the oil separated in the oil separator and to transmit the oil to the one or more compressors. The oil heat exchanger receives liquid refrigerant from the liquid pump and transmits evaporated refrigerant to the condenser unit. Evaporation of the liquid refrigerant in the oil heat exchanger provides cooling to the oil passing therethrough.

In another embodiment, the invention is a method of cooling compressor oil, and includes passing the compressor oil through a heat exchanger, pumping liquid refrigerant into the heat exchanger with a liquid refrigerant pump; and evaporating the pumped liquid refrigerant in the heat exchanger so as to cool the compressor oil passing therethrough.

In another embodiment, the invention is a system for cooling compressor oil, and includes means for passing the compressor oil through a heat exchanger, means for pumping liquid refrigerant into the heat exchanger with a liquid refrigerant pump; and means for evaporating the pumped liquid refrigerant in the heat exchanger so as to cool the compressor oil passing therethrough.

The above summary of the present invention is not intended to describe each illustrated embodiment or every implementation of the present invention. The figures and detailed description that follow more particularly exemplify these embodiments.

BRIEF DESCRIPTION OF THE DRAWINGS

The invention may be more completely understood in consideration of the following detailed description of various embodiments of the invention in connection with the accompanying drawings, in which.

Figure 1:
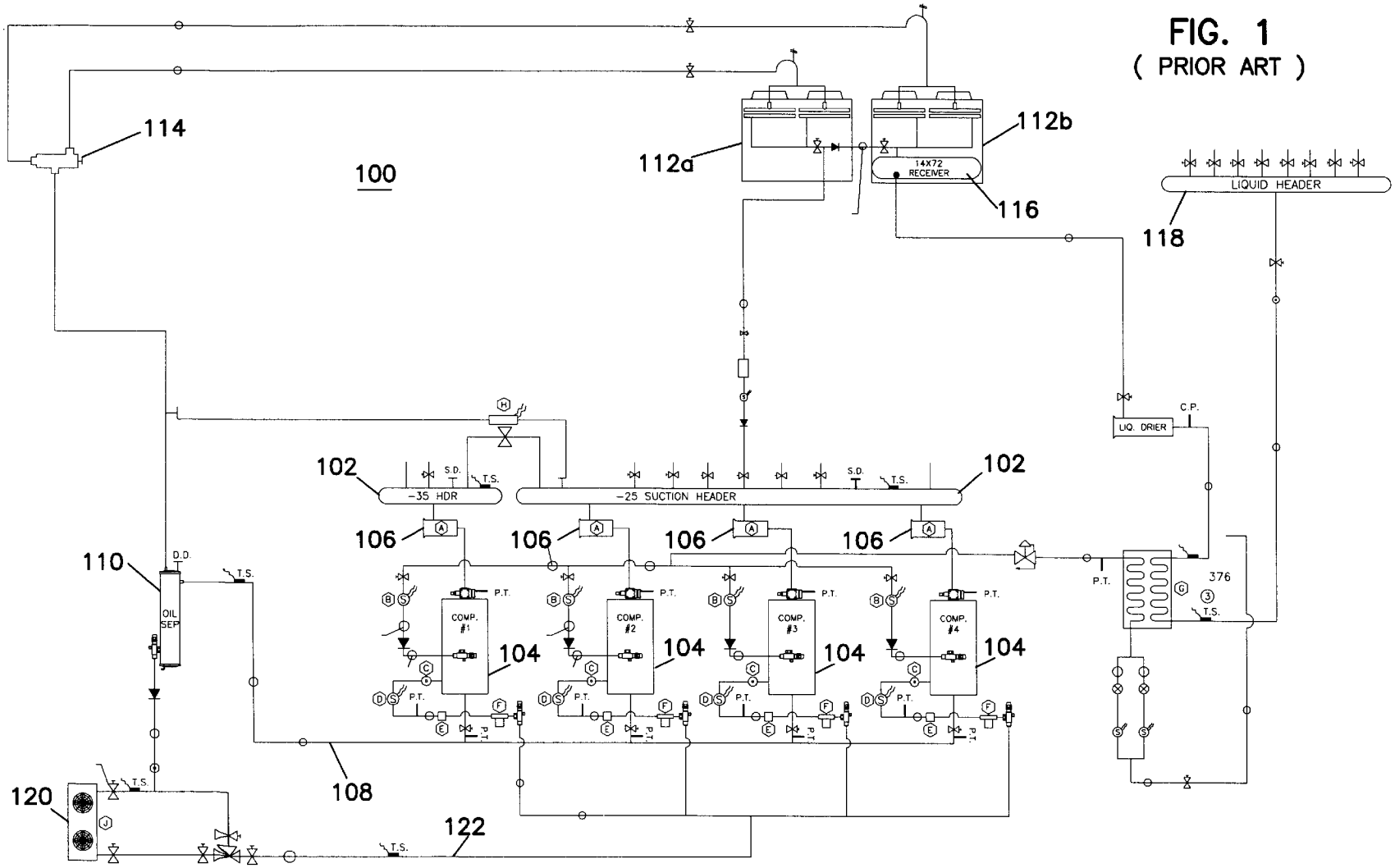
FIG. 1 ( PRIOR ART )
FIG. 1 shows a first embodiment of a prior art refrigeration system incorporating compressor oil cooling.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION

Refrigeration systems are used widely, for example in grocery stores, to provide cooled food storage and frozen food storage. Such refrigeration systems typically have at least one compressor to compress a gaseous refrigerant returning from a cooling unit (e.g., an evaporator). From the compressor, the compressed refrigerant is passed to a condenser where it is condensed back into the liquid state. Compressor discharge oil enters the refrigerant stream as it passes through the compressor. The oil is subsequently separated from the refrigerant in a separator. Since the refrigerant heats up on passing through the compressor, typically to a temperature in excess of 200° F., the separated oil is hot. Some types of compressors are capable of receiving the hot oil, for example a reciprocating compressor where the hot oil is returned to an oil sump. Other types of compressors, for example screw-type compressors, require that the oil is cooled externally, before being returned to the compressors.

In one commonly used approach for externally cooling the oil, the separated oil is passed through a forced-air-cooled heat exchanger. This requires the use of one or more large fans to move the air over the heat transfer surfaces of the heat exchanger. The fan, or fans, typically generate a significant amount of noise, which can create a disturbance to those working in the vicinity of the refrigeration unit. Since the fan, or fans, are often placed on the roof of the facility where the refrigeration unit is being used, the noise can also cause a disturbance to those who live close by.

Such a multi-compressor refrigeration system 100 is illustrated in schematic form in FIG. 1. A single compressor system has a similar configuration. The system 100 has one or more suction headers 102 to receive gaseous refrigerant from the food cooling units (not shown). Different suction headers may be used to receive refrigerant from cooling units operating at different temperatures. Refrigerant typically passes from the suction headers 102 to compressors 104 through suction filters 106. The compressed, hot refrigerant, mixed with oil from the compressors 104, passes along pipe 108 and enters at the top of oil separator 110. The liquid oil drops to the bottom of the separator 110, while the compressed refrigerant passes out of the separator to condensers 112*a* and 112*b*. One or more condensers 112*a* and 112*b* may be used, depending on the current load. For example, split condenser valve 114 may be opened to permit refrigerant to flow to the left condenser 112*a* when the load is high, and may be closed when the load is low, so that refrigerant flows only to the right condenser 112*b* under light load conditions. After condensing in the condensers 112, the now liquid refrigerant passes through and into a receiver tank 116. The liquid refrigerant may then pass out of the receiver 116 and flow to a liquid header manifold 118, from where it returns to the cooling units.

The hot oil separated from the refrigerant is removed from the separator 110 and passed through an air-cooled heat exchanger 120, where the hot oil gives up its heat to the air forced across the vanes of the heat exchanger by fans. The oil is forced through the heat exchanger 120 by the pressure of the compressed refrigerant passing through the oil separator 110. After passing through the heat exchanger, the cooled oil then returns along pipe 122 to the compressors 104.

Figure 2:
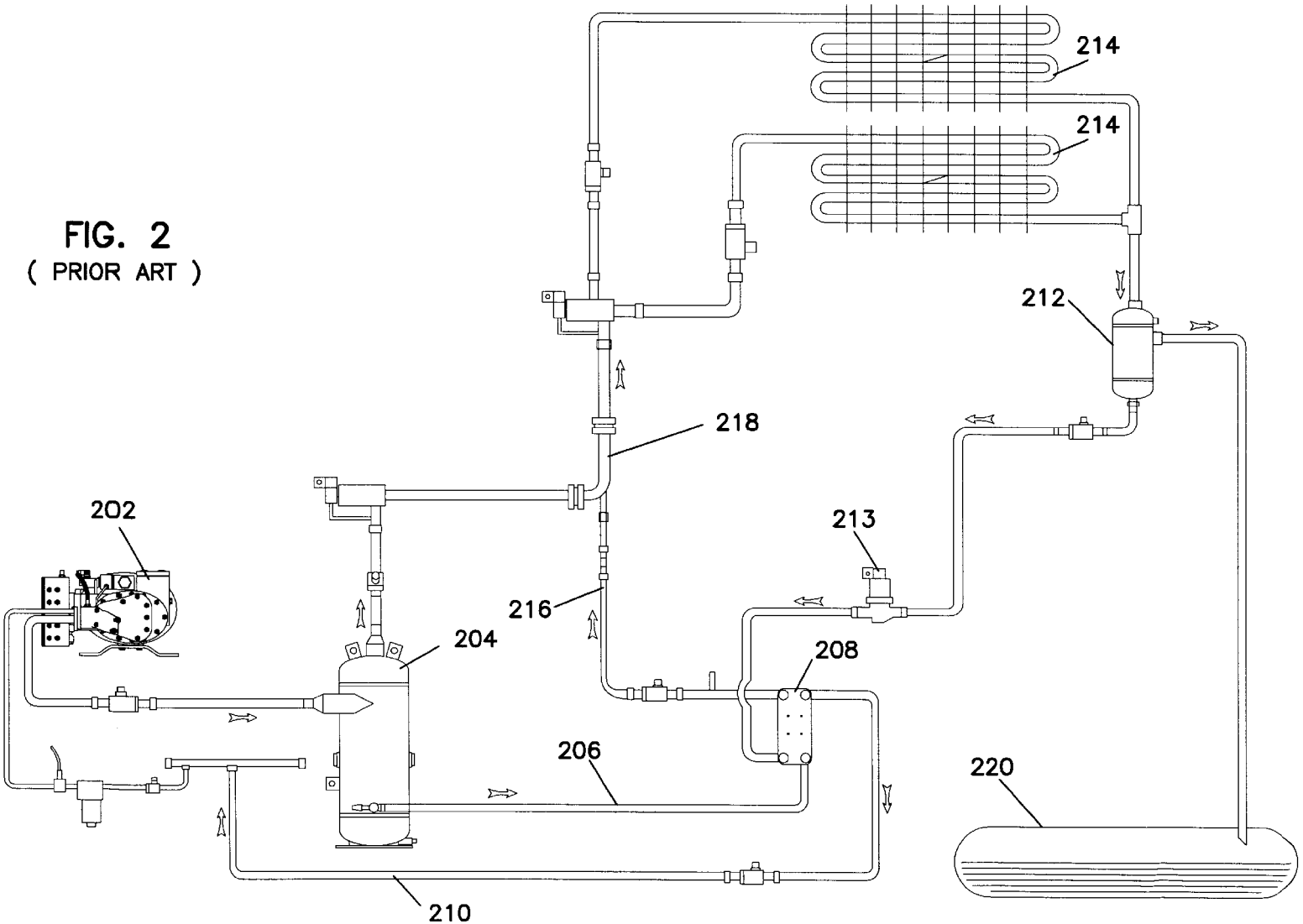
FIG. 2 ( PRIOR ART )
FIG. 2 shows a second embodiment of a prior art refrigeration system incorporating compressor oil cooling.

Another method of cooling the compressor oil is to pass it through a heat exchanger cooled with refrigerant. This avoids the problems of noise pollution associated with the air-cooled system. One known approach to doing this is shown in FIG. 2. Referring to FIG. 2, a compressor 202 receives refrigerant from a suction header (not shown) coupled to a cooling unit (not shown). The hot, compressed refrigerant is passed to a separator 204 in which the oil is separated by falling to the bottom of the tank. The separated oil passes along pipe 206 to a heat exchanger 208 which is cooled by refrigerant. The cooled oil is then returned along pipe 210 to the compressor 202.

The heat exchanger 208 receives liquid refrigerant from a flow-through receiver 212, which is fed by the condensed refrigerant from condensers 214. Flow control valve 213 controls the amount of refrigerant flowing to the heat exchanger 208, typically permitting a greater flow when the temperature of the oil increases. The refrigerant evaporates in the heat exchanger 208 and passes along the pipe 216 to a mixing pipe 218 that includes an internal venturi nozzle. The refrigerant gas from the heat exchanger 208 mixes with the hot compressed refrigerant from the separator 204, and passes on to the condensers 214, where it is condensed. The liquid refrigerant flows through the flow-through receiver 212, and most of the liquid refrigerant is directed to a main receiver 220. The main receiver 220 provides refrigerant to the cooling units (not shown). The flow circuit to and from the cooling units is omitted in this figure.

One problem with this system is that the refrigerant gas passing into junction pipe 218 from the heat exchanger 208 is typically at a pressure different from the pressure of the gas entering the mixing pipe 218 from the separator 204. Typically, the gas entering the mixing pipe 218 from the separator 204 is at a higher pressure, since it is on the downstream side of the compressor 202. If the hot, compressed refrigerant gas were to backflow to the heat exchanger, the cooling function of the heat exchanger would be compromised. Accordingly, two important steps must be taken to ensure that the refrigerant from the separator 204 does not backflow along the pipe 216 to the heat exchanger. First, the flow-through receiver 212 is positioned so that the column of liquid refrigerant between the flow-through receiver 212 and the heat exchanger 208 is sufficient to produce a head to force the liquid refrigerant through the heat exchanger 208. This may require that the condenser outlet is set at a height of ten feet or more above the heat exchanger 208. Second, since column of liquid does not typically produce a large pressure unless the column is very high, the junction pipe is provided with an internal venturi nozzle to reduce the pressure of the compressed gas from the separator, thus permitting gas from the heat exchanger 208 at a relatively lower pressure to mix in. The pipes on the input and output side of the mixing pipe 218 are typically required to be straight to ensure that the compressed gas flows properly through the venturi of the mixing pipe 218. This may be disadvantageous, particularly in situations where the refrigeration system is positioned in an area lacking in space, and where it may be more convenient to avoid the requirement of straight pipes.

The requirement that the receiver tank 212 be set higher than the heat exchanger 208 is often a disadvantage, particularly for those users who are unable to conveniently place the condensers 214 and flow-through receiving tank 212 on a roof.

Figure 3:
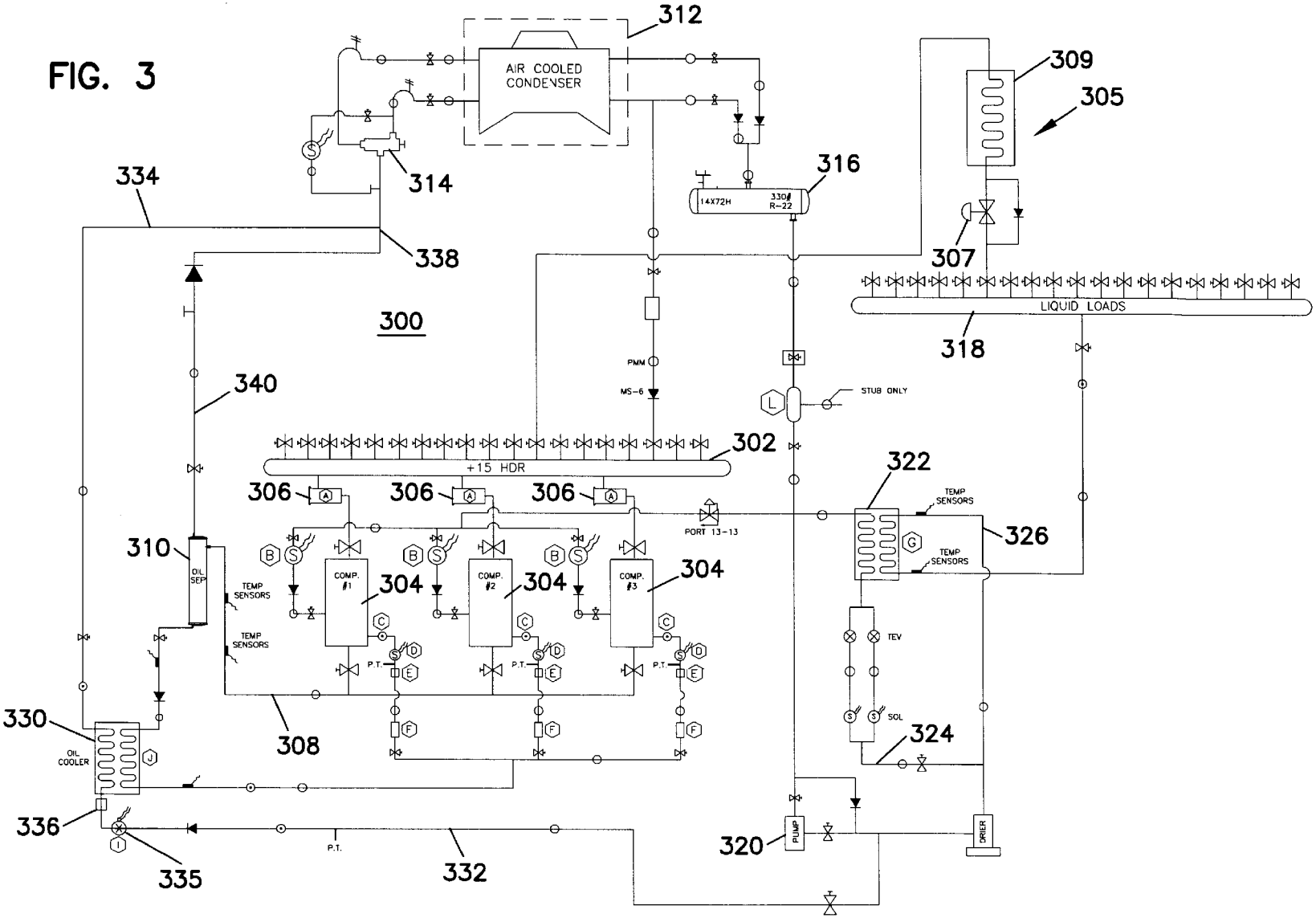
FIG. 3 shows a refrigeration system incorporating screw compressor oil cooling according to an embodiment of the present invention.

A configuration of refrigeration system 300 is illustrated in FIG. 3, which avoids the problems of noise arising from the air-cooling of the oil, but also avoids the problems associated with requiring the receiver tank to be placed higher than the heat exchanger, and may also obviate the need for a mixing tube fitted with a venturi nozzle. A multi-compressor system is shown, but the invention may operate with one or a different number of compressors.

The system 300 has one or more suction headers 302 to receive gaseous refrigerant from food cooling units 305 (a representative one of which is shown). The illustrated cooling unit 305 includes an expansion device 307 (e.g., an expansion valve) and an evaporator 309. Different suction headers may be used to receive refrigerant from cooling units operating at different temperatures. Refrigerant typically passes from the suction headers 302 to compressors 304 through suction filters 306. The compressed, hot refrigerant, mixed with oil from the compressors 304, passes along pipe 308 and enters the at the top of oil separator 310. The liquid oil falls to the bottom of the separator 310, while the compressed refrigerant passes out of the separator 310 along flow line 340 to condenser unit 312, which may include one or more separate condensers 312 separately operable dependent on load conditions. For example, split condenser valve 314 may be opened to permit refrigerant to flow the a supplementary condenser when the load is high, and may be closed when the load is low, so that refrigerant flows only to a primary condenser.

After condensing in the condensers 312, the refrigerant, now liquid, passes into a receiver tank 316. The liquid refrigerant may then pass out of the receiver 316, through a liquid pump 320, through a sub-cooler heat exchanger 322 and on to a liquid header manifold 318, where the liquid refrigerant returns to the cooling units 305. The liquid pump may be, for example, a model no. 860-IND, produced by Hy-Save of Detroit, Mich., or the like. Following the pump 320, a small fraction of the liquid refrigerant may be diverted along pipe 324 and passed through the heat exchanger 322 where it evaporates to sub-cool the liquid refrigerant passing along pipe 326 to the liquid header manifold 318.

The hot oil is removed from the refrigerant in the separator 310 and is passed through a refrigerant-cooled oil heat exchanger 330. A small fraction of the liquid pumped by the pump 320 is diverted along pipe 332 to the oil heat exchanger 330, where the refrigerant evaporates, thus cooling the oil passing therethrough. A flow regulator valve 335 may be used to control the flow of refrigerant along pipe 332 to the oil heat exchanger 330, for example in response to the oil temperature. An expansion valve 336 may be positioned on pipe 332 before the oil heat exchanger 330. The gaseous refrigerant returns along pipe 334 towards the condenser 312, where it is combined with compressed gas from the compressors 304 before entering the condenser 312. The junction 338 between the pipe 334 from the oil heat exchanger 330 and the pipe 340 from the oil separator 310 may be a simple t-junction, or may include a mixing pipe with a venturi nozzle.

An advantage of this approach is that the liquid pump 320, which may be installed in the refrigerant loop for other reasons, can also be used for cooling the compressor oil, thus avoiding the need for a separate flow-through receiver set at a height above the oil heat exchanger to produce a head of pressure. Therefore, the receiver 316, the liquid pump and the oil heat exchanger 330 may all be positioned at the same level. In addition, it may no longer be required to use a venturi-nozzled mixing pipe because the liquid pump 320 produces a large pressure difference. This saves on the cost of extra components, and may remove the requirement to have straight sections of a particular length leading to and from the venturi nozzle.

As noted above, the present invention is applicable to cooling compressor oil in refrigeration systems and is believed to be particularly applicable to cooling oil in systems using screw compressors. Accordingly, the present invention should not be considered limited to the particular examples described above, but rather should be understood to cover all aspects of the invention as fairly set out in the attached claims. Various modifications, equivalent processes, as well as numerous structures to which the present invention may be applicable will be readily apparent to those of skill in the art to which the present invention is directed upon review of the present specification. The claims are intended to cover such modifications and devices.

What is claimed is:

1. An apparatus for cooling oil in a refrigeration system compressor, comprising:

one or more compressors coupled to receive gaseous refrigerant from cooling units;

an oil separator coupled to receive compressed refrigerant gas from the one or more compressors, the oil separator being adapted for separating oil from the compressed refrigerant gas;

a condenser unit coupled to receive compressed refrigerant gas from the oil separator;

a liquid pump coupled to receive liquid refrigerant from the condenser unit; and an oil heat exchanger coupled to receive the oil separated from the compressed refrigerant gas at the oil separator and to convey the oil to the one or more compressors, and coupled to receive liquid refrigerant from the liquid pump and to convey evaporated refrigerant to the condenser unit;

wherein evaporation of liquid refrigerant in the oil heat exchanger provides cooling to the oil passing through the oil heat exchanger.

2. An apparatus as described in claim 1, further comprising a receiver unit coupled to receive liquid refrigerant from the condenser unit and to pass liquid refrigerant to the liquid pump.

3. An apparatus as described in claim 1, further comprising a venturi-free coupling between the oil separator, the oil heat exchanger and the condenser unit, to transmit gaseous refrigerant from the oil separator to the condenser unit and from the oil heat exchanger to the condenser unit.

4. An apparatus as described in claim 1, further comprising a liquid load manifold coupled to receive liquid refrigerant from the liquid pump, the liquid load manifold being coupled to the cooling units.

5. An apparatus as described in claim 4, further comprising a sub-cooling heat exchanger coupled to cool liquid refrigerant passing from the liquid pump to the liquid load manifold.

6. An apparatus as described in claim 5, wherein the sub-cooling heat exchanger is coupled to receive a portion of the liquid refrigerant output from the liquid pump, the portion of the liquid refrigerant evaporating in the sub-cooling heat exchanger to cool the liquid refrigerant passing to the liquid load manifold.

7. An apparatus as described in claim 6, wherein an output from the subcooling heat exchanger is coupled to the compressor unit to return refrigerant evaporated in the sub-cooling heat exchanger to the compressor unit.

8. An apparatus as described in claim 1, wherein at least one of the one or more compressors is a screw-type compressor.

9. A method of cooling compressor oil in a refrigeration system, comprising:

passing the compressor oil through a heat exchanger;

pumping liquid refrigerant into the heat exchanger with a liquid refrigerant pump; and evaporating the pumped liquid refrigerant in the heat exchanger so as to cool the compressor oil passing therethrough.

10. A method as recited in claim 9, further comprising combining gaseous refrigerant from the heat exchanger with compressed gaseous refrigerant, wherein the combining occurs venturi-free.

11. A method as recited in claim 9, further comprising separating the compressor oil from refrigerant gas before cooling the compressor oil.

12. A method as recited in claim 9, further comprising pumping liquid refrigerant to a liquid load manifold.

13. A method as recited in claim 12, further comprising pre-cooling the pumped liquid refrigerant between a condenser unit and the liquid load manifold.

14. A system for cooling compressor oil in a refrigeration system, comprising:

means for passing the compressor oil through a heat exchanger;

means for pumping liquid refrigerant into the heat exchanger with a liquid refrigerant pump; and means for evaporating the pumped liquid refrigerant in the heat exchanger so as to cool the compressor oil passing therethrough.

* * * * *